US009341446B2

(12) United States Patent
Dennison

(10) Patent No.: US 9,341,446 B2
(45) Date of Patent: May 17, 2016

(54) OSCILLATING TARGET

(71) Applicant: Travis Dennison, Zionsville, IN (US)

(72) Inventor: Travis Dennison, Zionsville, IN (US)

( * ) Notice: Subject to any disclaimer, the term of this patent is extended or adjusted under 35 U.S.C. 154(b) by 50 days.

(21) Appl. No.: 14/183,595

(22) Filed: Feb. 19, 2014

(65) Prior Publication Data

US 2015/0233685 A1 Aug. 20, 2015

(51) Int. Cl.

| | |
|---|---|
| ***F41J 9/02*** | (2006.01) |
| ***H01F 7/06*** | (2006.01) |
| ***H01F 7/14*** | (2006.01) |
| ***F41J 7/06*** | (2006.01) |

(52) U.S. Cl.

CPC .... *F41J 9/02* (2013.01); *F41J 7/06* (2013.01); *H01F 7/064* (2013.01); *H01F 7/14* (2013.01)

(58) Field of Classification Search

CPC ..... F41J 9/24

USPC ..... 273/369, 371, 370, 375, 390, 366, 367, 273/368, 393, 407, 386, 392; 368/179, 163, 368/162; 362/392, 386

See application file for complete search history.

(56) References Cited

U.S. PATENT DOCUMENTS

| | | | | |
|---|---|---|---|---|
| 4,551,794 | A * | 11/1985 | Sandell | 362/392 |
| 4,723,233 | A | 2/1988 | Beebe | |
| 5,676,378 | A * | 10/1997 | West | 273/390 |
| 8,534,672 | B2 * | 9/2013 | Brune | 273/406 |
| 2006/0125185 | A1 * | 6/2006 | Rolfe | 273/390 |
| 2013/0207347 | A1 * | 8/2013 | Sovine | 273/390 |

* cited by examiner

*Primary Examiner* — Gene Kim
*Assistant Examiner* — Rayshun Peng
(74) *Attorney, Agent, or Firm* — Maginot, Moore & Beck, LLP

(57) ABSTRACT

An oscillating target includes a base, a stand, and a pendulum. The base includes an electromagnetic coil and a power source. The stand is fixedly coupled to the base and the pendulum is rotatably supported by the stand. The pendulum includes a permanent magnet arranged opposite a target face. The permanent magnet is arranged on the pendulum at a position nearest to the base. The power source is configured to selectively operate the electromagnetic coil to generate a magnetic field to affect the permanent magnet to rotate the pendulum and thereby move the target face.

13 Claims, 7 Drawing Sheets

OSCILLATING TARGET

BACKGROUND

Target practice has been enjoyed for many years by those who shoot firearms or other projectile weapons in hunting, shooting sports, or in combat. Target practice provides a way for a shooter to hone his skills in a controlled environment to prepare for live, natural settings. Alternatively, target practice is an enjoyable and challenging activity in itself as a way for a shooter to relieve stress without the goal of shooting in a natural setting. While target practice is commonly conducted with stationary targets due to their availability and ease of use, movable targets can provide an additional challenge to further increase one's skill or entertainment level. Movable targets provided by skeet and trap shooting equipment are often used by shotgun shooters. However, single projectile shooters, such as those shooting pellet guns, bb guns, rifles, handguns, bows and arrows, crossbows, and paintballs have not previously had access to comparable moving targets with which to practice.

By engaging in target practice with a moving target, single projectile shooters can improve the timing and aim of their shots by becoming accustomed to shooting at an inconsistent position. Additionally, such target practice will assist single projectile shooters in improving their judgment of distance in relation to their weapons' speeds as the distance between the firearm or projectile weapon and the target will be constantly changing. Thus, single projectile shooters will improve their shooting skills by practicing shooting at a moving target because the target practice engages the shooter in consistent focus on a small target area in motion.

SUMMARY

An oscillating target includes a base coupled to a stand which supports a pendulum. The pendulum includes a target end arranged farther from the base and a magnet end opposite the target end and arranged nearer to the base. The stand rotatably supports the pendulum at a central area between the target end and the magnet end. When the pendulum rotates relative to the stand, the magnet end of the pendulum moves in one direction relative to the stand and the target end of the pendulum moves in the opposite direction relative to the stand. The target end of the pendulum includes an enlarged face to serve as a target at which a shooter can aim. The magnet end of the pendulum includes a permanent magnet. The base includes an electromagnetic coil coupled to an on/off switch via a circuit. When the switch is in the on position, the circuit intermittently provides current flow to the coil to generate a magnetic field which repels the permanent magnet on the magnet end of the pendulum. Accordingly, when the switch is in the on position, the pendulum rotates relative to the stand and thereby moves the target.

DETAILED DESCRIPTION

Figure 1C:
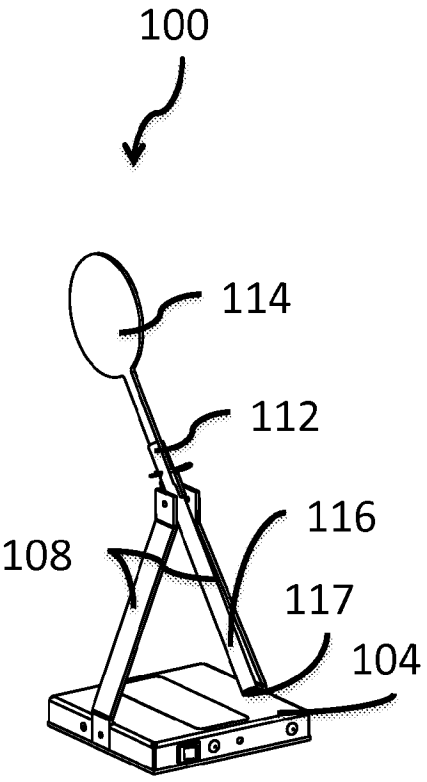
FIG. 1C is a perspective view of the oscillating target in a third position.
Figure 1B:
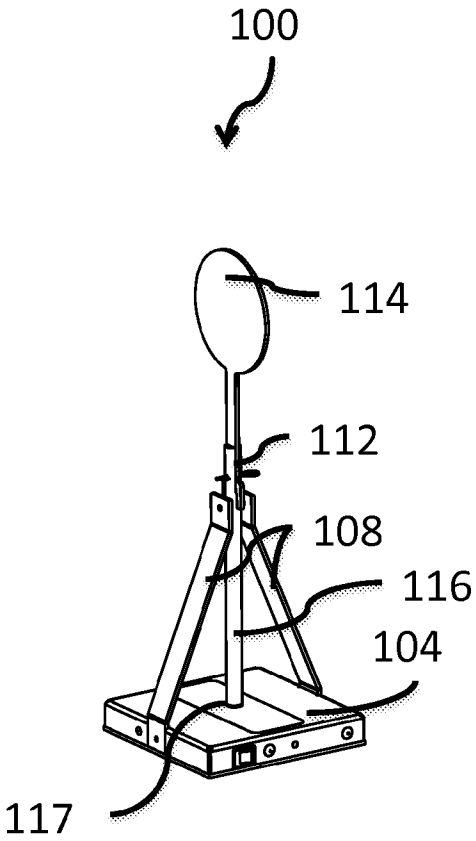
FIG. 1B is a perspective view of the oscillating target in a second position.
Figure 1A:
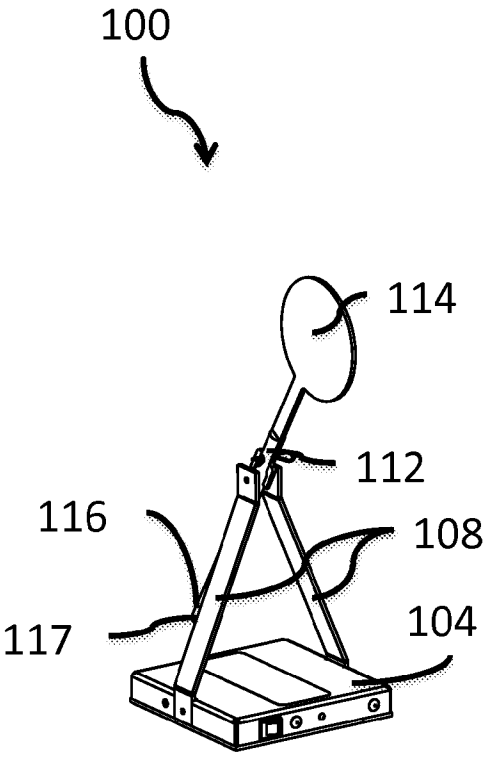
FIG. 1A is a perspective view of the oscillating target in a first position.

As shown in FIGS. 1A-1C, the oscillating target device 100 includes a base 104 supporting a stand 108 which rotatably supports a pendulum element 112. The stand 108 may be fixedly coupled to the base 104 and the pendulum element 112 is rotatably coupled to the stand 108 in such a manner that the pendulum element 112 is suspended above and free to rotate relative to the base 104. The pendulum element 112 includes a target portion 114 at which a shooter can aim and includes a magnet portion 116 opposite the target portion 114. The magnet portion 116 includes a permanent magnet 117 positioned away from the target portion 114 which produces oscillation of the target portion 114 as described herein. The permanent magnet 117 can be arranged such that either a positive or a negative pole faces the base 104. By way of example, the permanent magnet 117 is defined herein as having a positive pole facing the base 104. It is further contemplated that the magnet portion 116 itself may be a magnet with one of the poles at the free end of the portion. By way of example, the permanent magnet 117 can be a neodymium magnet and can have, for example, approximately two to five pounds of pull.

Figure 2:
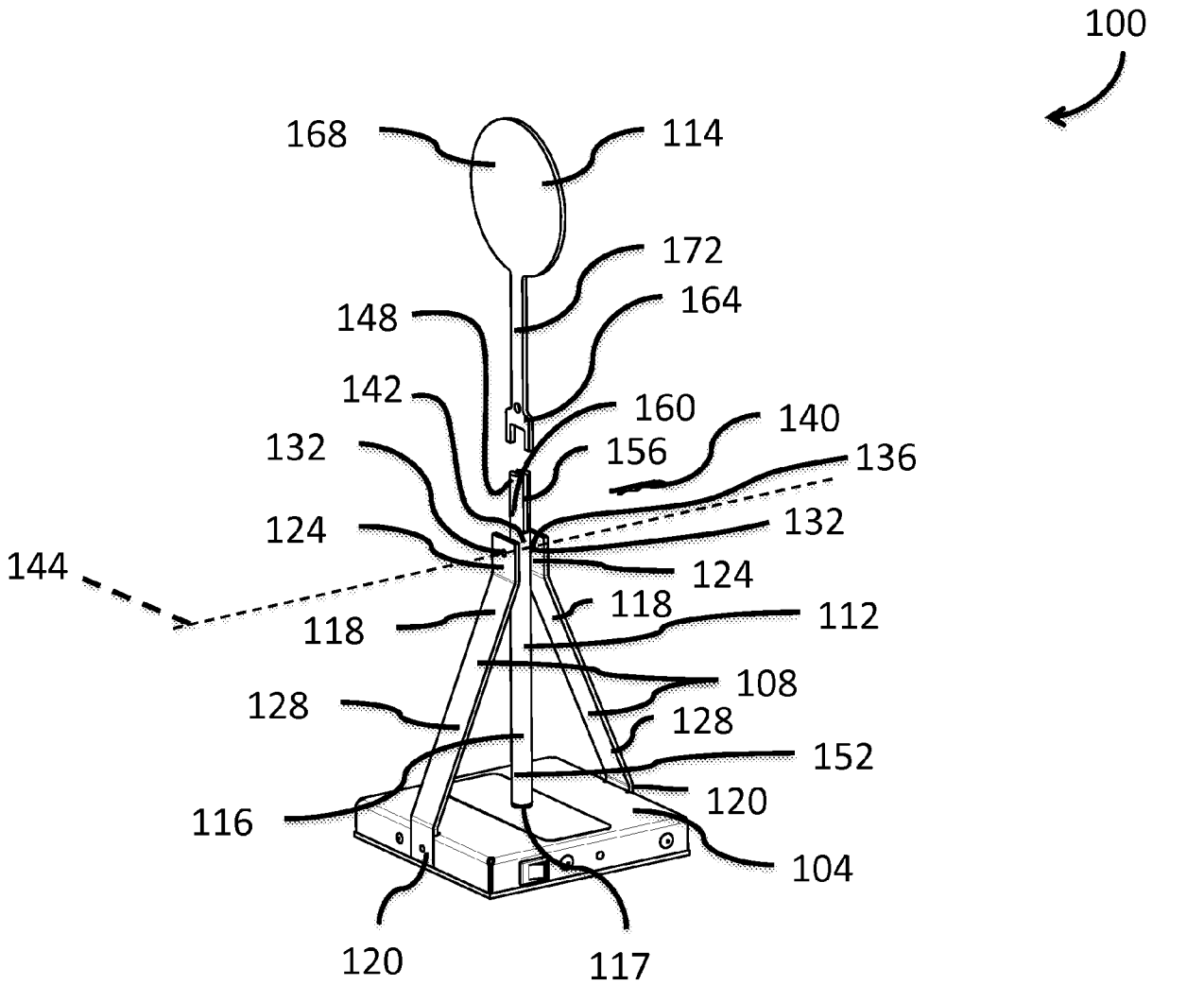
FIG. 2 is a perspective view of the oscillating target of FIGS. 1A-1C in the second position and partially disassembled.

Turning now to FIG. 2, the oscillating target device 100 is shown partially disassembled. As shown, the target portion 114 and the magnet portion 116 of the pendulum element 112 are separable from one another and are fastened together with a pendulum fastener 140. The stand 108 includes two arms 118, each of which has a base portion 120, a pendulum mount portion 124 opposite the base portion 120, and an angled portion 128 between the base portion 120 and the pendulum mount portion 124. The base portions 120 and the pendulum mount portions 124 of the arms 118 are parallel to one another on different planes and the angled portions 128 extend at angles between the base portions 120 and the pendulum mount portions 124. When the oscillating target device 100 is assembled as shown in FIGS. 1A-1C, the base portions 120 of the arms 118 are fixedly coupled to opposite sides of the base 104 and extend away from the base 104 and toward one another. Thus, the pendulum mount portions 124 are positioned spaced apart from one another, but adjacent to and parallel to one another above the base 104.

Each pendulum mount portion 124 includes a fastening opening 132 configured to receive a fastening member 136 to rotatably couple the pendulum element 112 to the stand 108. The magnet portion 116 of the pendulum element 112 may be substantially cylindrically shaped and includes a rotation locus 142 at which the magnet portion 116 is rotatably coupled to the pendulum mount portions 124 of both arms 118 with the fastening member 136. The fastening member 136 can be a pin or another fastener configured to be received within the fastening openings 132 in the pendulum mount portions 124 and in a corresponding fastening opening in the magnet portion 116 at the rotation locus 142. The fastening member 136 couples the pendulum element 112 to the stand 108 at the rotation locus 142 so as to be rotatable about a rotation axis 144. The rotation axis 144 extends along a diameter of the magnet portion 116 in a direction parallel to the base 104. When the pendulum element 112 is coupled to the stand 108, the pendulum element 112 is suspended above the base 104 and is able to rotate freely about the fastening member 136. This arrangement permits the pendulum element 112 to oscillate relative to the base 104.

An upper portion 148 of the magnet portion 116 extends above the rotation locus 142 and a lower portion 152 of the magnet portion 116 extends below rotation locus 142. The permanent magnet 117 is arranged at a lowermost point on the lower portion 152 of the magnet portion 116, opposite the upper portion 148. Accordingly, when the magnet portion 116 rotates about the rotation axis 144, the upper portion 148 of the magnet portion 116 moves in one direction relative to the base 104 and the bottom portion 152 of the magnet portion 116 moves in an opposite direction relative to the base 104. The magnet portion 116 further includes a slot 156 and a fastening opening 160 formed in the upper portion 148 and configured to removably fasten the target portion 114 to the magnet portion 116.

Figure 3:
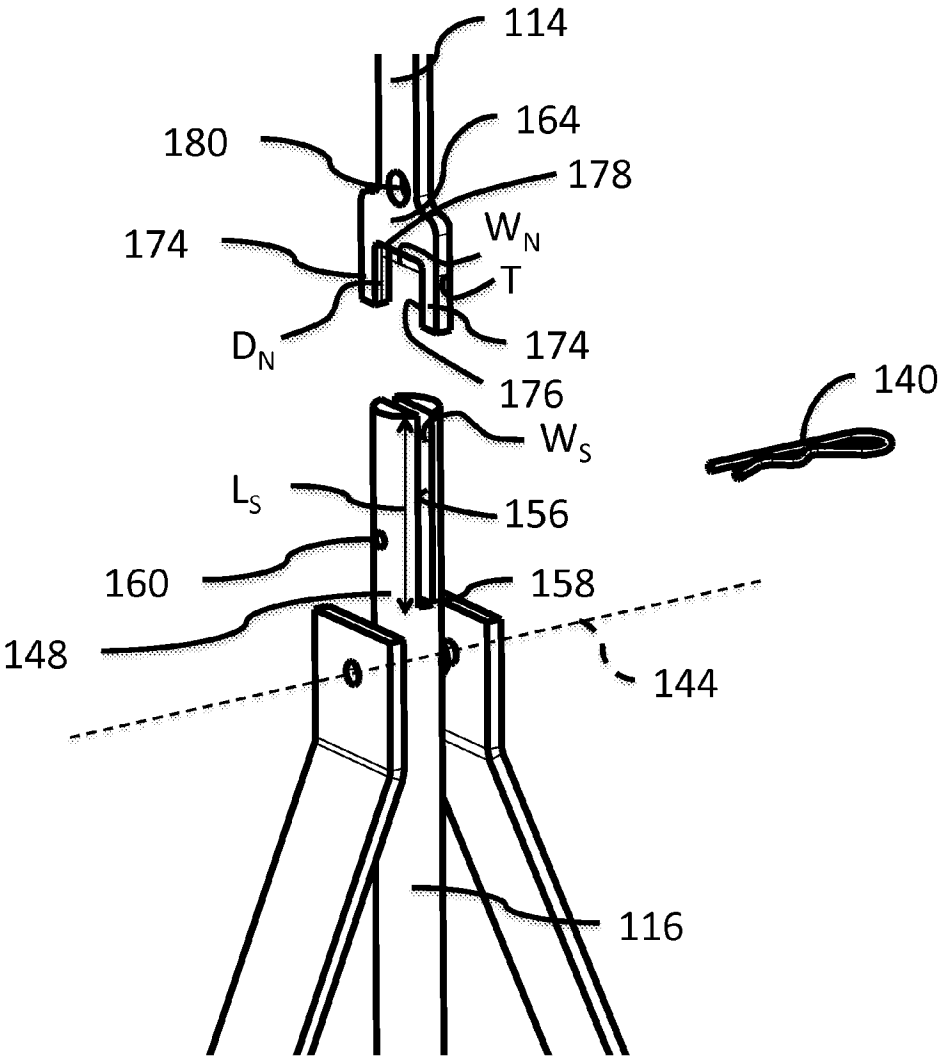
FIG. 3 is a perspective view of a portion of the oscillating target of FIG. 2.

Turning now to FIG. 3, a partial view of the pendulum element 112 is shown. The slot 156 is formed along the length of the magnet portion 116 across a diameter of the magnet portion 116. The slot 156 is sized and configured to snugly receive the target portion 114 and has a slot width $W_s$ and a slot length $L_s$. The fastening opening 160 is formed along a diameter of the magnet portion 116 and perpendicularly relative to the slot 156. The fastening opening 160 is sized and configured to receive the pendulum fastener 140 which may be a cotter pin, as shown in FIG. 3, to allow easy removal. The fastening opening 160 is formed so as to extend through the magnet portion 116 to intersect with the slot 156. Accordingly, when the target portion 114 of the pendulum element 112 is received within the slot 156, the pendulum fastener 140 is received within the fastening opening 160 and also passes through the slot 156.

Returning to FIG. 2, the target portion 114 of the pendulum element 112 includes a fastening end 164, a target face 168 arranged opposite the fastening end 164, and a stem 172 between the fastening end 164 and the target face 168. When the target portion 114 is coupled to the magnet portion 116 as shown in FIGS. 1A-1C, the target face 168 is positioned away from the base 104 and provides a target surface at which a shooter can aim. In the embodiment shown, the target face 168 may be substantially circular or disk shaped defined at a selectable diameter. The diameter may be large, to provide a larger target for a novice, or small, to provide a smaller target for an expert. For instance, the diameter of the target face 168 may be in the range of 4-12 inches. In alternative embodiments, the target face 168 can have various shapes and sizes to provide various targets at which a shooter can aim. By way of example, the target face 168 can have a geometric shape selected from a circle, a rectangle, a triangle, an oval, a pentagon, and the like. Alternatively, the target face 168 can have a non-geometric or irregular shape.

Turning again to FIG. 3, the fastening end 164 of the target portion 114 has a thickness T which is less than the slot width $W_s$ of the slot 156 such that the fastening end 164 can fit closely within but still slide into the slot 156. The fastening end 164 includes two legs 174 separated by a notch 176 and a fastening opening 180. The notch 176 has a notch width $W_N$ that is slightly wider than the diameter of the magnet portion 116 and a notch depth $D_N$ configured to enable the legs 174 to extend beyond the slot 156 when the target portion 114 is received in the slot 156 of the magnet portion 116. The length $L_s$ of the slot 156 is sized to overlap the fastening opening 180 and to extend above the fastening opening 180 to add rigidity to the connection of the target portion 114 and the magnet portion 116. The fastening opening 180 is positioned above and adjacent to the notch 176 and extends through the fastening end 164. The fastening opening 180 is sized and configured to receive the pendulum fastener 140.

To fasten the target portion 114 to the magnet portion 116, the fastening end 164 of the target portion 114 is received within the slot 156 in the magnet portion 116, and the pendulum fastener 140 is received within both the fastening opening 180 and the fastening opening 160. Because the notch width $W_N$ is slightly wider than the diameter of the magnet portion 116, and because the notch depth $D_N$ extends into the fastening end 164 of the target portion, when the fastening end 164 is fully received within the slot 156, the legs 174 extend slightly beyond the diameter of the magnet portion 116 and a top 178 of the notch 176 contacts a bottom 158 of the slot 156 so that the notch 178 mates with the slot 156. When the notch 178 is mated with the slot 156, the fastening opening 180 in the fastening end 164 of the target portion 114 is aligned with the fastening opening 160 in the upper portion 148 of the magnet portion 116. The pendulum fastener 140, such as an arm of the cotter pin, is then insertable through both the fastening opening 180 and the fastening opening 160 to fasten the target portion 114 in a fixed position relative to the magnet portion 116. This arrangement allows easy removal of the pendulum fastener 140 to enable replacement of the target portion 114 on the oscillating target device 100. The target portion 114 can be replaced when it has been damaged or when a different target face is desired.

Figure 4:
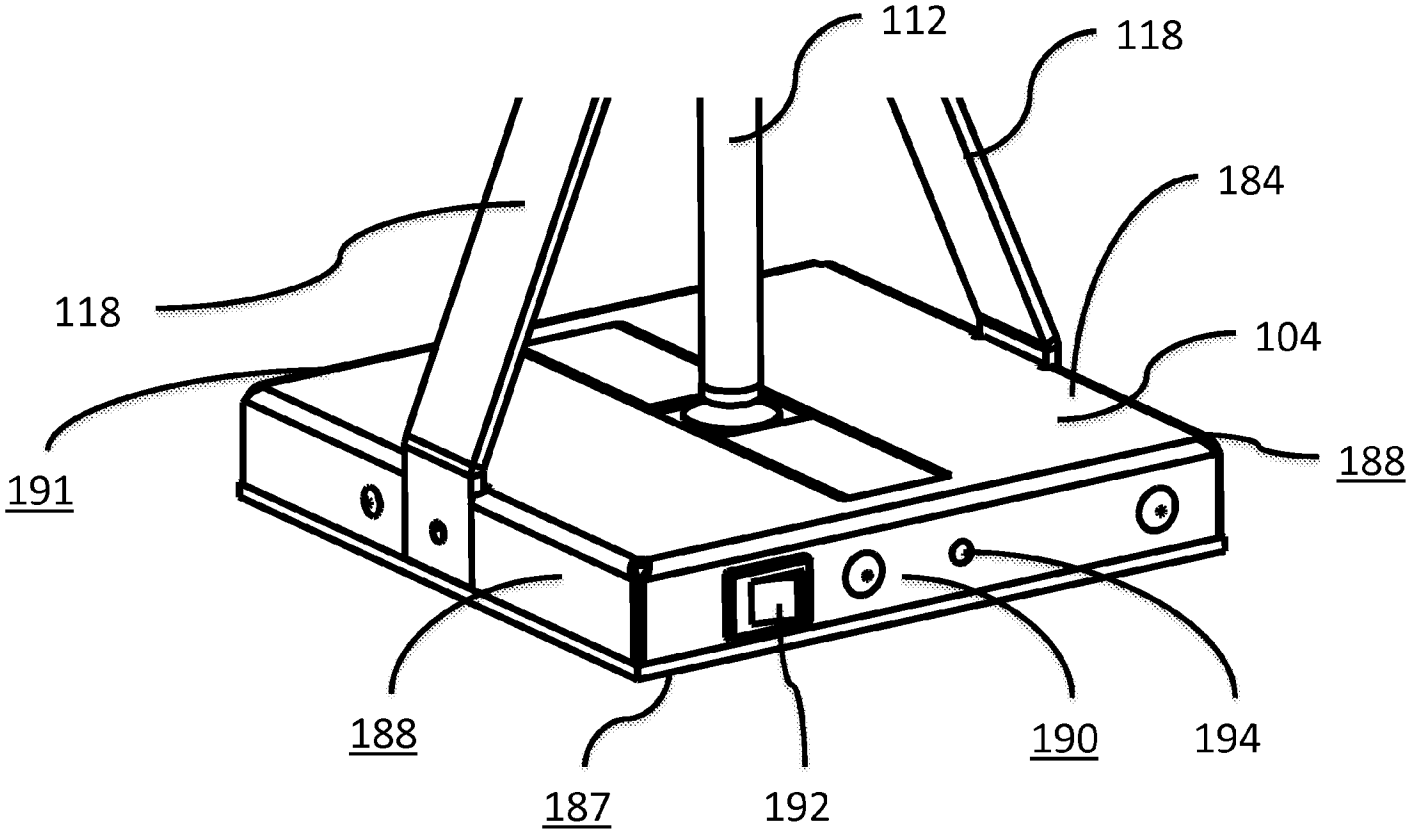
FIG. 4 is a perspective view of a base of the oscillating target of FIGS. 1A-1C.

Turning now to FIG. 4, the base 104 of the oscillating target device 100 includes a housing 184 shaped substantially as a hollow rectangular prism. The housing 184 includes a top surface 186 arranged to face the pendulum element 112, a bottom surface 187 opposite the top surface 186, two opposite sides 188 to which the arms 118 of the stand 108 are fixed, a front surface 190 having an on/off switch 192 and an indicator 194, and a back surface 191 opposite the front surface. Together, the surfaces and sides of the housing 184 form an internal space within the base 104 which houses other components of the base 104.

Figure 5:
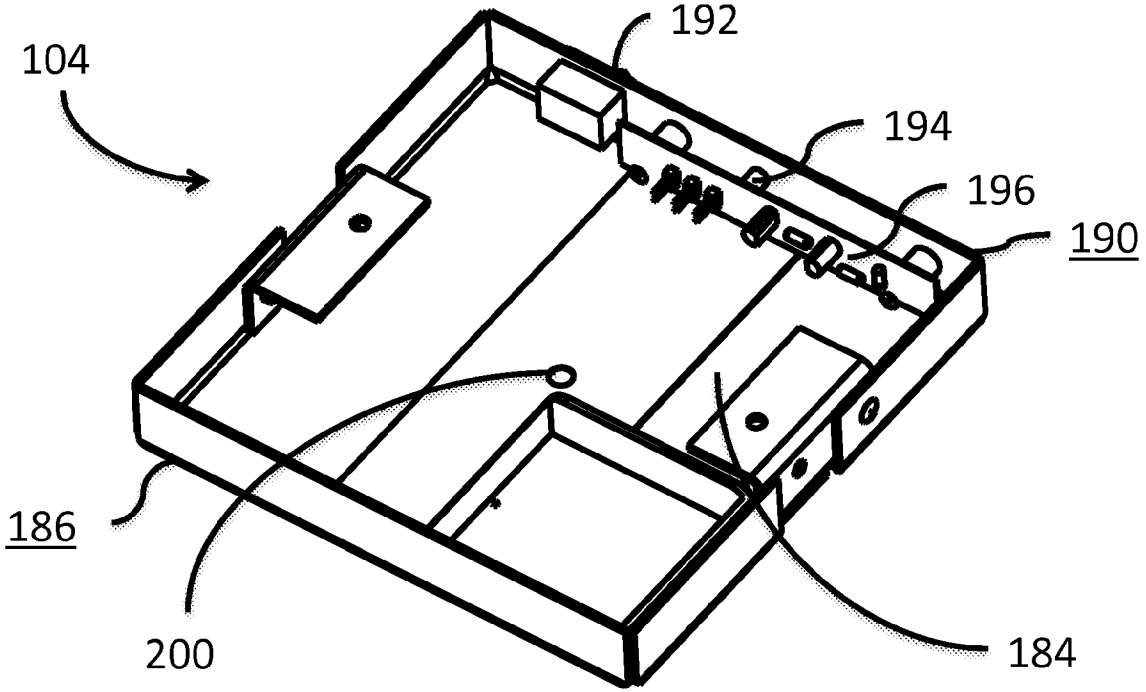
FIG. 5 is a cut-away bottom perspective view of the base of FIG. 4.

Turning now to FIG. 5, a bottom view of the base 104 is shown with the bottom surface 187 (shown in FIG. 4) removed. As shown, the base 104 further includes a circuit board 196 arranged within the housing 184 adjacent to the front surface 190. The circuit board 196 is electrically coupled to the on/off switch 192 and to the indicator 194, such as an LED light (the electrical connections are not shown). In other embodiments, the indicator can be another mechanism which provides visual feedback to a user that the oscillating target device 100 is activated. The circuit board 196 is also electrically coupled to an electromagnetic coil 200 which is fixedly positioned on the base 104. The electromagnetic coil 200 is positioned so as to be accessible via the top surface 186 of the base 104. In this embodiment, the electromagnetic coil 200 is fixed to the base 104 via an adhesive. In alternative embodiments, however, the electromagnetic coil 200 can be fixed to the base 104 via another method of fixation. By way of example, the electromagnetic coil 200 can have an inductance of approximately one millihenry.

Figure 6:
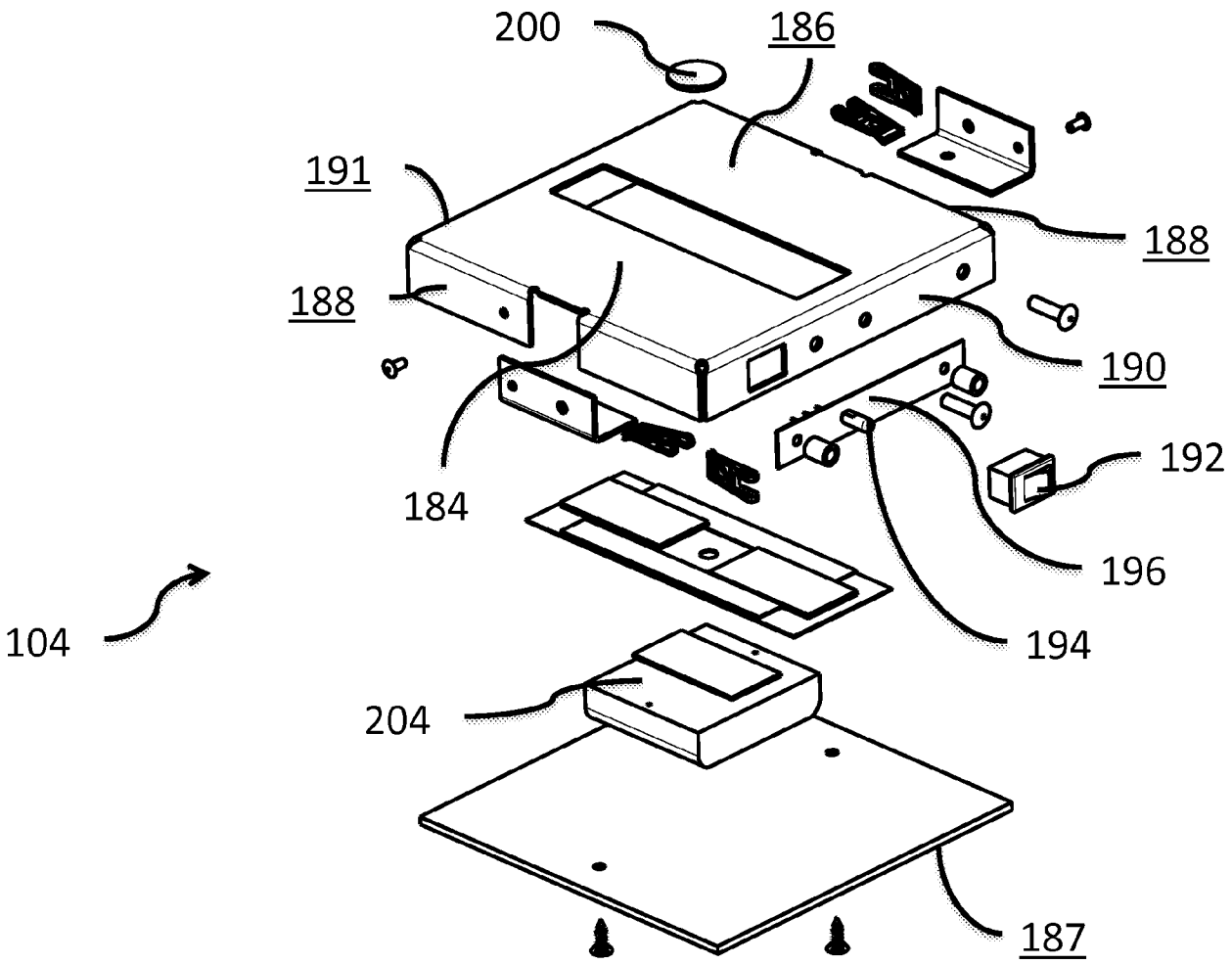
FIG. 6 is an exploded view of the base of FIG. 4 including a circuit board.

Turning now to FIG. 6, an exploded perspective view of the base 104 is shown to further illustrate the components of the base 104. As shown, the base 104 includes a power source 204, which may be a battery or another source for electrical energy, including a solar cell. The battery 204 is electrically coupled to the circuit board 196 in such a manner that operating the on/off switch 192 on the circuit board 196 electrically connects the battery 204 to the indicator 194 and to the electromagnetic coil 200. The base 104 may also include a spacer 202 configured to fit into an opening 203 formed in the top surface 186 of the housing 184. The spacer 202 is configured to support the electromagnetic coil 200 in such a manner that the electromagnetic coil 200 is accessible via the top surface 186 while remaining electrically connected to the power source 204 and the circuit board 196 within the housing 184. The housing 184 can be made of a variety of materials, such as aluminum or another material which provides a durable casing for the base 104. The spacer 202, however, must be made of a non-metallic material due to its proximity to the electromagnetic coil 200 so that the material of the spacer 202 will not interfere with the magnetic fields generated by the electromagnetic coil 200. Additionally, the spacer 202 must be made of a material which will not interfere with the magnetic field generated by movement of the permanent magnet 117. Thus, the spacer 202 may be made of plastic or another material which is non-metal or a non-ferromagnetic metal that and will not interfere with magnetic fields generated by the electromagnetic coil 200.

Figure 7:
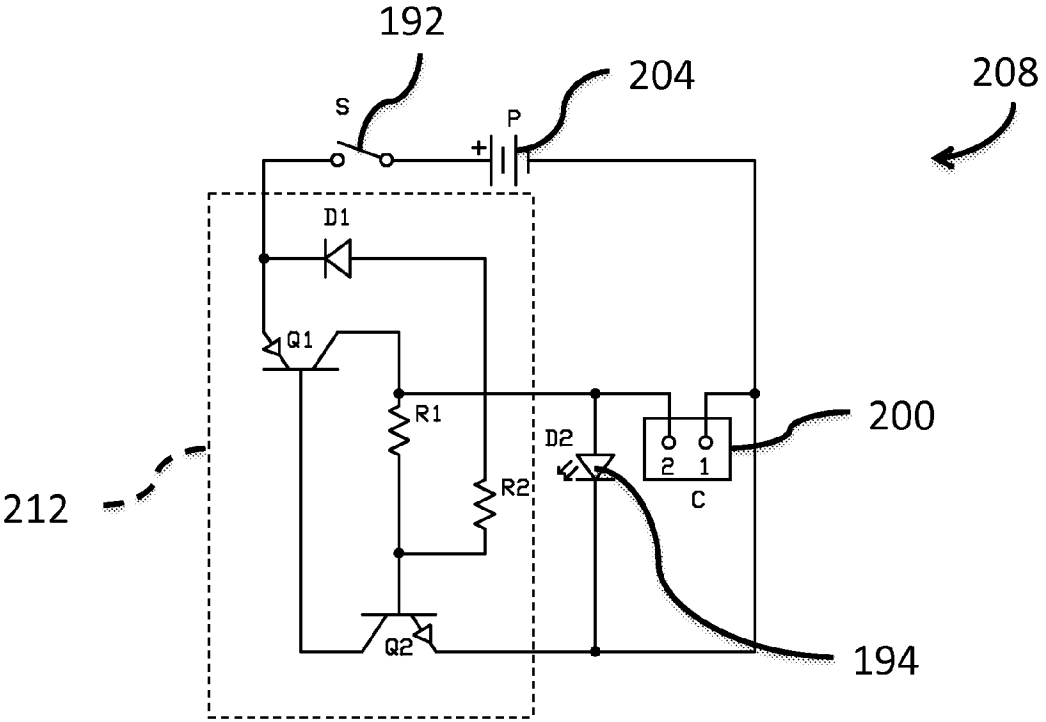
FIG. 7 is a schematic drawing of a circuit for use on the circuit board of FIG. 6.

Turning now to FIG. 7, a schematic drawing of an exemplary electrical circuit 208 is shown which can be included on the circuit board 196 to operate the oscillating target device 100. The electrical circuit 208 is shown only to provide an example since other electrical circuits may be provided to operate the oscillating target device 100 in the same or similar manner. As shown in FIG. 7, when the on/off switch 192 is switched "on," the circuit is closed to electrically couple the power source 204 to the indicator 194 and to the electromagnetic coil 200. The power source 204 is electrically coupled to the electromagnetic coil 200 via an oscillating circuit portion 212 configured to vary the electrical current provided to the electromagnetic coil 200 to thereby vary the magnetic field produced by the electromagnetic coil 200 and, more particularly, the polarity of the field.

Prior to operating the oscillating target device 100, the pendulum element 112 is at rest in a vertical position as shown in FIG. 1B. Because the electromagnetic coil 200 generates no magnetic field prior to operation of the oscillating target device 100, the permanent magnet 117 is unaffected and the pendulum element 112 rests with the permanent magnet 117 positioned nearest to and parallel with the top surface 186 of the base 104.

To operate the oscillating target device 100, the on/off switch 192 is switched to the "on" position to complete the electrical circuit 208 between the power source 204 and the indicator 194 and the electromagnetic coil 200. The indicator 194 then provides a visual indication to the user that the oscillating target device 100 is receiving electrical energy and the electromagnetic coil 200 then receives electrical current to generate a first magnetic field. The first magnetic field can be either positive or negative, but by way of example the first magnetic field is positive. The positive magnetic field generated by the electromagnetic coil 200 repels the positive pole of the permanent magnet 117 which is arranged facing the base 104. Accordingly, the magnet portion 116 of the pendulum element 112 is moved away from the electromagnetic coil 200. This movement is restricted to one plane perpendicular to the rotation axis 144 because the magnet portion 116 is rotatably fixed to the stand 108 at the fastening member 136. Movement of the magnetic portion 116 in one direction moves the target portion 114 in the opposite direction. The magnetic field generated by the permanent magnet 117 is sufficient to move the oscillating target device 100 toward a first furthest position shown in either FIG. 1A or FIG. 1C.

After an amount of time has elapsed, the electrical circuit 208 turns the electromagnetic coil 200 off so that the permanent magnet 117 is no longer repelled. Accordingly, the permanent magnet 117 free falls back toward the resting position shown in FIG. 1B. After another elapsed amount of time, the electromagnetic coil 200 is turned back on and the free fall momentum of the pendulum element 112 combined with the repelling magnetic force swings the pendulum element 112 in the opposite direction. The elapsed amounts of time are determined by the components and arrangement provided in the oscillating circuit portion 212 and can be altered by changing those components and/or arrangement.

The rate of oscillation of the oscillating target device 100 depends on the mechanical arrangement of the pendulum element 112 as well as the electrical arrangement of the oscillating circuit portion 212. Changing the mechanical arrangement or shape, size, or weight of the pendulum element 112 changes the momentum and swing of the pendulum element 112 which alters the oscillation of the oscillating target device 100. Additionally, altering the electrical arrangement of the oscillating circuit portion 212 changes the elapsed amounts of time between turning the electromagnetic coil 200 on and off which alters the oscillation of the oscillating target device 100.

In an alternative embodiment, the oscillating movement of the oscillating target device 100 can be produced by alternatingly operating the electromagnetic coil 200 to attract the permanent magnet 117 and turning the electromagnetic coil 200 off. In this embodiment, the user may provide a mechanical force to the pendulum element 112 to initially generate the movement of the pendulum element 112. Subsequent movement of the pendulum element 112 is produced by alternating periods of attraction and free fall momentum of the pendulum element 112.

In another alternative embodiment, the oscillating movement of the oscillating target device 100 can be produced by alternatingly reversing the polarity of the magnetic field generated by the electromagnetic coil 200. In this embodiment, the permanent magnet 117 is alternatingly attracted toward and repelled from the electromagnetic coil 200. In this embodiment, after an amount of time has elapsed, the electrical circuit 208 provides the electromagnetic coil 200 with electrical current flowing in the opposite direction to generate a second magnetic field which is opposite the first magnetic field. When the polarity of the electromagnetic coil 200 is the same as that of the permanent magnet 117, the permanent magnet is repelled from the electromagnetic coil 200, and when the polarity of the electromagnetic coil 200 is the opposite, the permanent magnet is attracted to the electromagnetic coil 200. When the polarity of the electromagnetic coil 200 is reversed, the momentum of the pendulum element 112 combined with the magnetic force of the permanent magnet 117 will rotate the pendulum element 112 to move the oscillating target device 100. The electromagnetic coil 200 and circuitry are configured to pivot the pendulum element 112 between the two farthest positions (shown in the other of FIG. 1A and FIG. 1C) as long as the oscillating target device 100 is energized.

The target portion 114 of the pendulum element 112 may be formed of a variety of materials. Harder materials can allow multiple uses of the same target portion 114, even after the target face 168 has been struck. In this instance, the material may provide an audible impact sound, like the ringing of a bell, to inform the shooter of a hit. Alternatively, the target portion 114 may be formed of a softer material that is penetrated by the projectile, such as a paper or cardboard based material.

While the oscillating target has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An oscillating target device, comprising:

a base made of aluminum, the base including:

an upwardly facing surface;

a portion made of a non-metal material and arranged in the upwardly facing surface;

an electromagnetic coil; and a power source;

a stand fixedly coupled to the base; and an elongated pendulum element rotatably supported by the stand and including a target face at one end and a permanent magnet at an opposite end, the pendulum element supported so that the permanent magnet is at a position nearest to the base, wherein the power source is configured to selectively operate the electromagnetic coil to generate a magnetic field to affect the permanent magnet to move the pendulum element such that the permanent magnet only passes over the portion of the base made of the non-metal material.

2. The oscillating target device of claim 1, further comprising:

an electrical circuit coupled to the power source and to the electromagnetic coil, the electrical circuit configured such that the power source selectively operates the electromagnetic coil to move the pendulum element in both a first direction and a second direction.

3. The oscillating target device of claim 1, further comprising:

an electrical circuit coupled to the power source and to the electromagnetic coil, the electrical circuit configured such that the power source selectively operates the electromagnetic coil to alternatingly generate magnetic fields having opposite polarities.

4. The oscillating target device of claim 1, wherein the magnetic field affects the permanent magnet to move the pendulum element in a continuous pendulum motion.

5. The oscillating target device of claim 1, wherein:

the electromagnetic coil is supported by the portion of the base.

6. The oscillating target device of claim 1, wherein the pendulum element includes a first portion, including the target face, removably coupled to a second portion, including the permanent magnet.

7. The oscillating target device of claim 6, wherein the second portion of the pendulum element is rotatably coupled to the stand.

8. The oscillating target device of claim 6, wherein:

a fastening end of the first portion has a thickness; and an upper portion of the second portion has a diameter and includes a slot formed along the diameter, the slot having a width that is larger than the thickness to enable the fastening end of the first portion to slide closely within the slot.

9. The oscillating target device of claim 8, wherein the fastening end includes a notch having a width that is larger than the diameter of the upper portion to enable the first portion to mate with the upper portion at the notch.

10. The oscillating target device of claim 9, wherein:

the slot has a bottom surface and the notch has a top surface; and when the first portion is mated with the upper portion, the bottom surface of the slot contacts the top surface of the notch.

11. The oscillating target device of claim 8, wherein the first portion and the second portion each include at least one fastener opening configured to receive a fastener member, the fastener openings positioned such that when the first portion is slid within the slot, the fastener openings are aligned to receive the fastener member therein.

12. The oscillating target device of claim 11, wherein the fastener member is a cotter pin.

13. The oscillating target device of claim 1, wherein the target face has a shape selected from common geometric shapes including a rectangle, a circle, a triangle, an oval, and a pentagon.

* * * * *